United States Patent [19]

Yamamoto

[11] Patent Number: 4,916,446

[45] Date of Patent: Apr. 10, 1990

[54] REMOTE CONTROL DEVICE

[75] Inventor: Michio Yamamoto, Mobara, Japan

[73] Assignee: Futaba Denshi Kobyo Kabushiki Kaisha, Mobara, Japan

[21] Appl. No.: 215,527

[22] Filed: Jul. 6, 1988

[30] Foreign Application Priority Data

Jul. 11, 1987 [JP] Japan ..... 62-172098

[51] Int. Cl.[4] ..... H04Q 9/14

[52] U.S. Cl. ..... 340/825.570; 375/27; 340/825.69; 340/825.72; 341/176

[58] Field of Search ..... 340/825.62, 825.69, 340/825.57, 825.72; 375/27, 25, 69, 84, 85, 122; 370/113, 114, 109; 341/81, 176; 371/67, 68

[56] References Cited

U.S. PATENT DOCUMENTS 4,739,311 4/1988 Yamamoto et al. ..... 341/176

FOREIGN PATENT DOCUMENTS 8605340 9/1986 World Int. Prop. O. ..... 375/27

*Primary Examiner*—Donald J. Yusko
*Assistant Examiner*—Eric Oliver Pudpud
*Attorney, Agent, or Firm*—Oblon, Spivak, McClelland, Maier & Neustadt

[57] ABSTRACT

A remote control device capable of substantially eliminating affection of noise and radio interference and increasing a transmission rate to improve a response speed by alternately transmitting an absolute data and a difference data. When joysticks of a transmitter are operated depending on the desired amount of operation of a control drive unit, the transmitter alternately arranges an absolute signal and a difference signal corresponding to the operation and generates a modulated control signal, which is received by a radio receiver loaded on the control drive unit. The radio receiver demodulates the control signal into an absolute data signal and a difference data signal, which are then converted into a signal of only an absolute value by a converter. Then, a drive section drives and controls the movable controls of the control drive unit in response to the signal.

9 Claims, 4 Drawing Sheets

REMOTE CONTROL DEVICE

BACKGROUND OF THE INVENTION

1. Field of the Invention

This invention relates to a remote control device, and more particularly to a remote control device used for a radio control transmitter and receiver system for a model drive unit or an industrial drive unit, such as, for example, a crane, a pile driver or the like.

2. Description of the Prior Art

A transmission system for driving and controlling a radio-controlled drive unit generally uses a pulse position modulation (PPM) system which generates a signal having a pulse width corresponding to movement of joysticks provided in a transmitter for transmission or a pulse-code modulation (PCM) system which generates a series of pulse code signals corresponding to movement of sticks in the transmitter for transmission. In general, the PCM system is extensively used, because it has less generation of noise and radio interference as compared to the PPM system.

However, in the conventional PCM system, it is required to limit a bandwidth of a transmitted signal so as to prevent radio interference. However, this results in a significant increase in a transmission time, because the conventional PCM system feeds an absolute data for determining the amount of control of each movable control of the drive unit for every channel corresponding to movement of the joysticks. In order to solve such a problem, there is proposed to expand the bandwidth to increase a data transmission rate. However, this is practicallY impossible, because the bandwidth must be limited as explained hereinabove. As a result, a response of the controlled drive unit is delayed.

—SUMMARY OF THE INVENTION

The present invention has been made in view of the foregoing disadvantage of the prior art.

Accordingly, it is an object of the present invention to provide a remote control device which is hardly affected by noise and radio interference and increases a transmission rate so as to improve a response speed of a drive unit to be controlled by alternately transmitting an absolute data and a difference data.

It is another object of the present invention to provide a remote control device which is less affected by an error in a difference data and accurately controls a drive unit.

In accordance with the present invention, a remote control device is provided. The remote control device includes transmission means for alternately arranging an absolute signal and a difference signal corresponding to operation of joysticks to generate a control signal modulated and receiving means loaded on a control drive unit. The receiving means receives the control signal and demodulates it into corresponding absolute data signal and difference data signal, which are alternately output therefrom. The device further includes storage means for storing the absolute data signal and difference data signal therein, conversion means for converting the absolute data signal and difference data signal stored in the storage means into a signal of only an absolute value and generating it as its output signal, and drive means for driving and controlling movable controls of the control drive unit in response to the output signal of the conversion means.

In the present invention, when the joysticks of the transmitter are operated to cause each of the movable controls of drive unit to move in a predetermined amount, the transmitter generates the modulated control signal alternately arranging the absolute signal and difference signal corresponding to the amount of displacement of the sticks from an antenna. Then, when the transmitted control signal is received by the receiver on the drive unit, the control signal is demodulated into the absolute data signal and difference data signal, which are alternately output and stored in the storage means. The absolute data signal and difference data signal are then converted into an absolute value signal by the conversion means, and the drive means drives and controls the movable controls of the drive unit in response to the converted signal.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Now, a radio control device according to the present invention will be described in detail hereinafter with reference to the accompanying drawings.

Figure 1A:
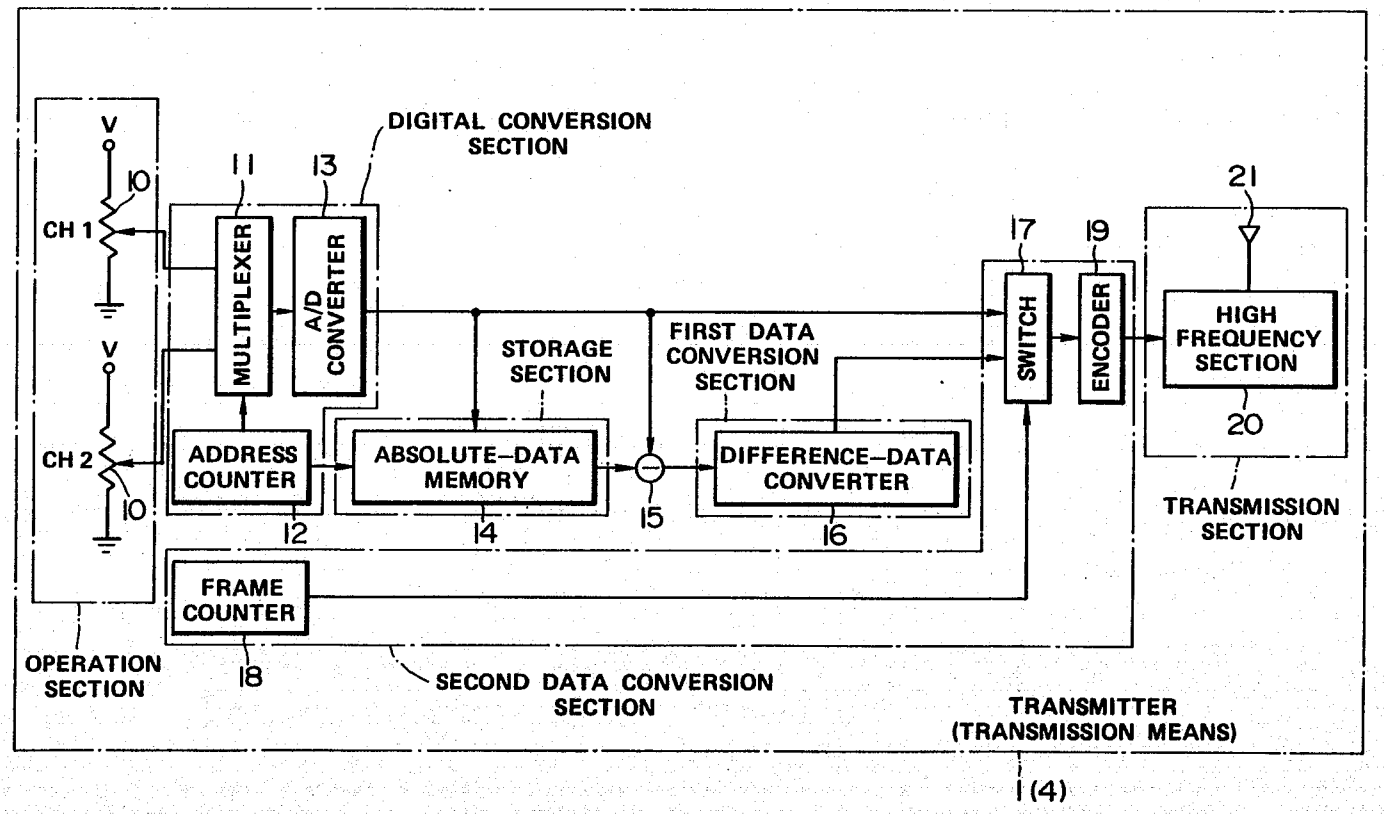
FIGS. 1A and 1B are each block diagram showing an embodiment of a remote control device according to the present invention.
Figure 1B:
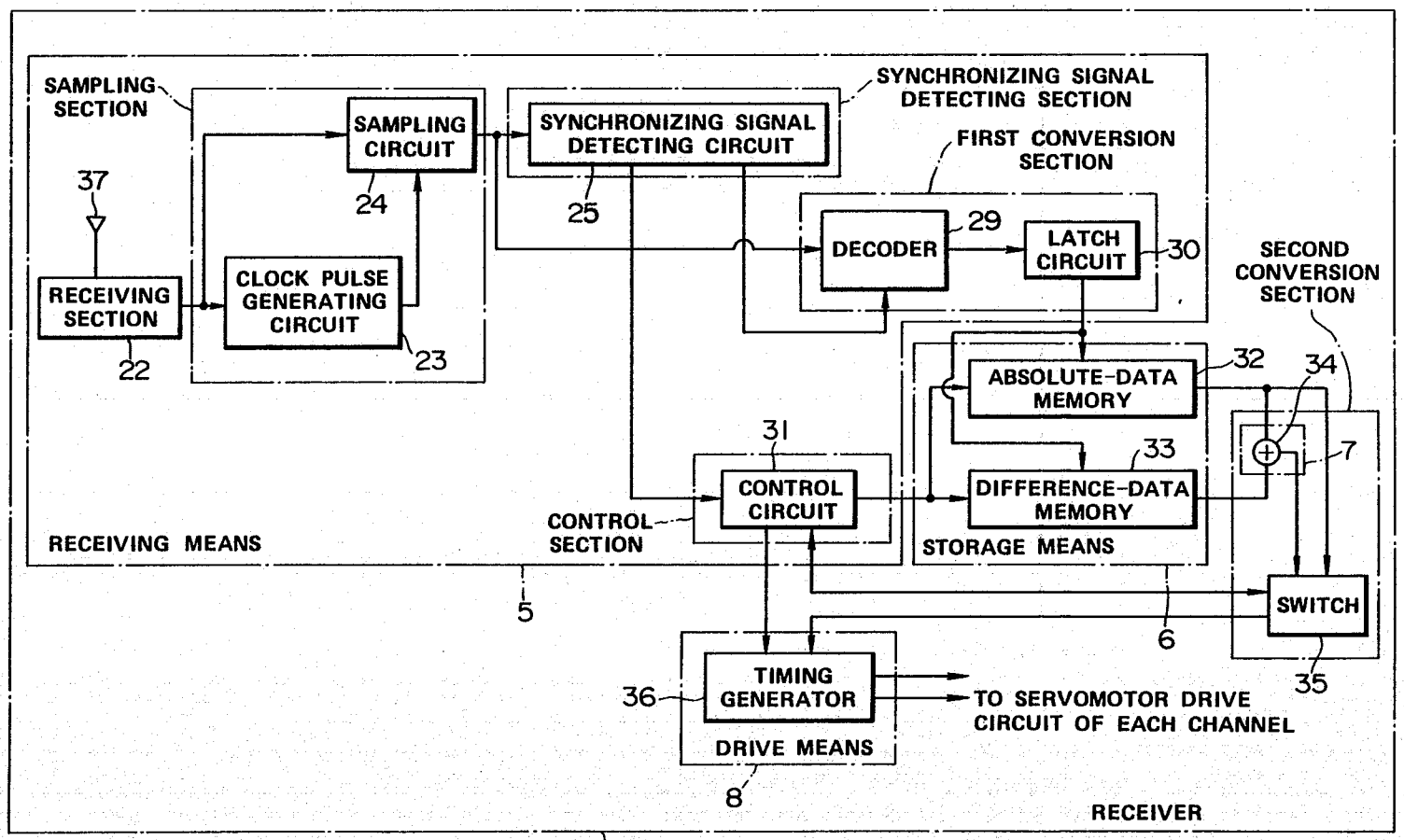
Figure 2:
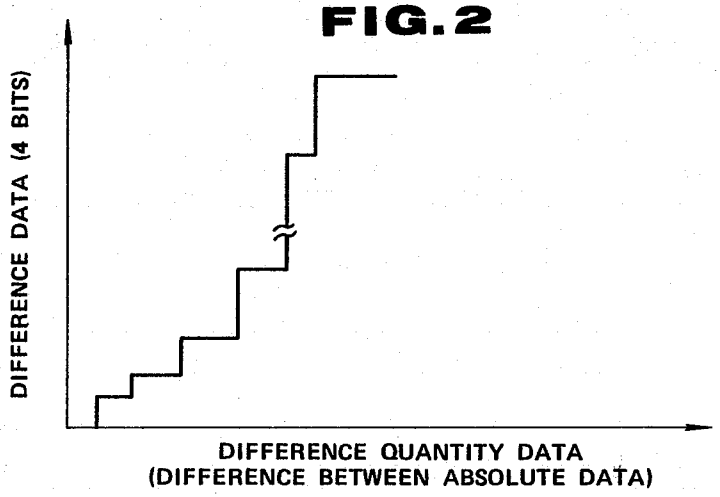
FIG. 2 is a graphical representation showing conversion characteristics of a difference data converter in transmission means in the radio control device shown in FIG. 1A.
Figure 3:
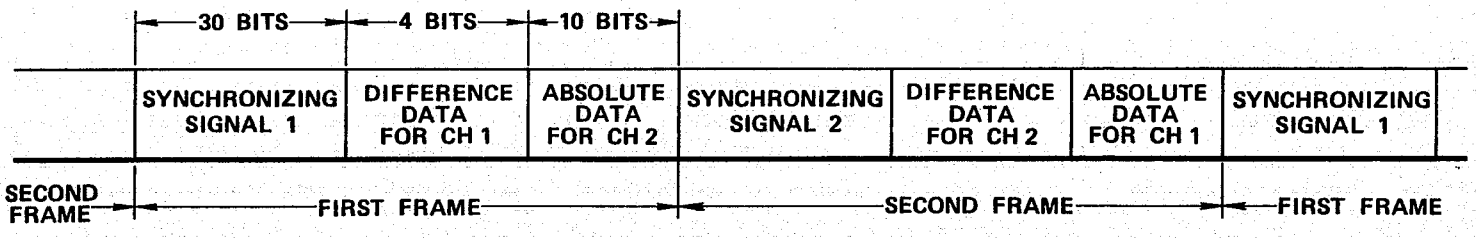
FIG. 3 is a view showing a form of a signal encoded by an encoder in the radio control device shown in FIG. 1A.
Figure 4:
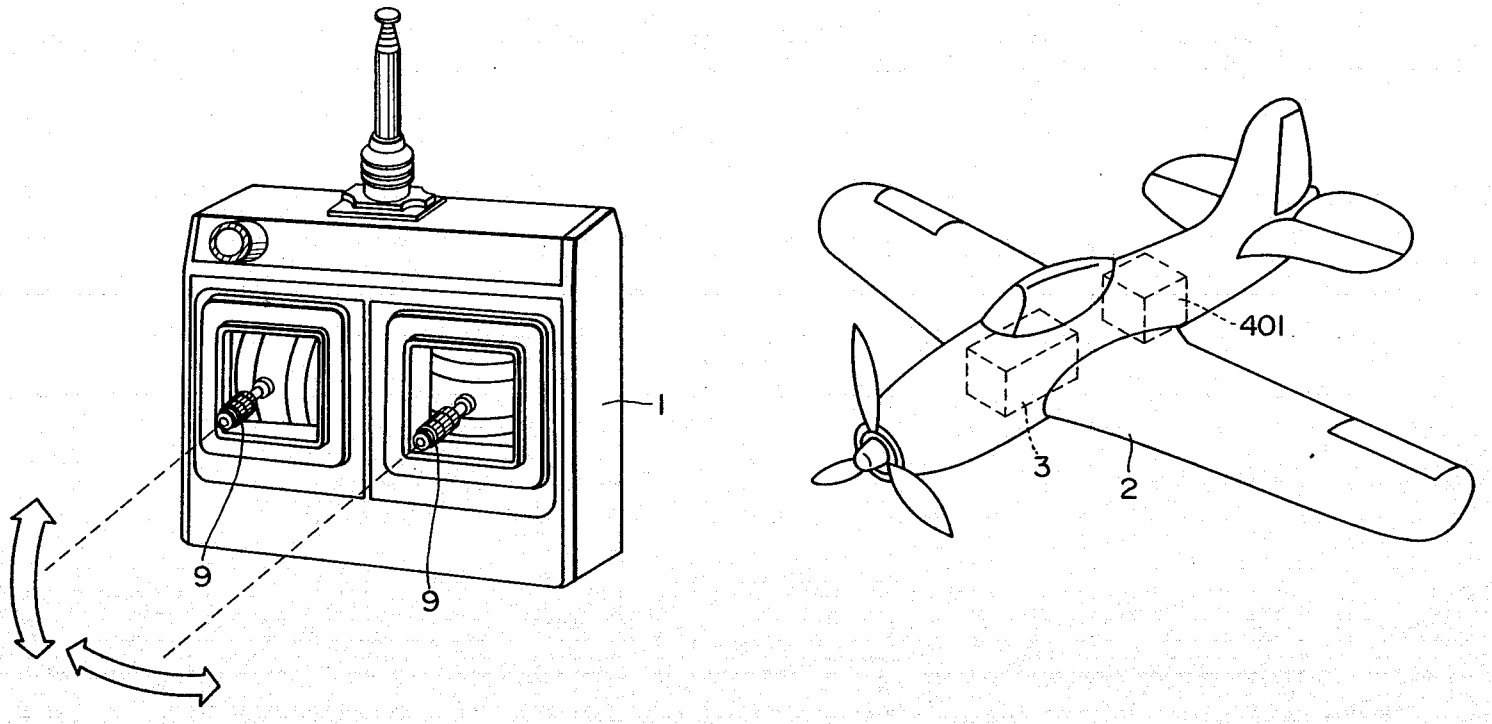
FIGS. 4 is a schematic perspective view showing a transmitter and receiver system for a radio control model airplane to which the radio control device of FIGS. 1A and 1B applied, respectively.

FIGS. 1A and 1B shows an embodiment of a remote control device according to the present invention, FIG. 2 shows conversion characteristics of a difference data converter in transmission means incorporated in the device of FIG. 1A, FIG. 3 shows a form of a signal encoded by an encoder in the device of FIG. 1A, and FIG. 4 shows a transmitter and receiver system for a radio control model airplane to which the device of FIGS. 1A and 1B are applied, respectively.

The following embodiment of the present invention will be described in connection with a two-channel remote control device.

A remote control device of the illustrated embodiment, as shown in FIG. 4, generally includes a transmitter 1 provided with joysticks 9, a receiver 3 loaded on a radio control model airplane 2 which is an object to control, and drive means 401 including servomotors loaded on the model airplane 2. The transmitter 1 includes transmission means 4. On the other hand, the receiver 3 includes receiving means 5, storage means 6, conversion means 7 and drive means 8. The transmitter 1 modulates a signal containing an absolute data which is an absolute signal generated from the transmitter 1 in accordance with displacement of the joysticks 9 indicating the amount of displacement of the joysticks 9 and a difference data which is a difference signal calculated from a new or present absolute data and an old o previous absolute data and alternately transmit it the modulated signal as a control signal. The control signal is received by the receiver 3 where the control signal is subjected to demodulation and converted into a data of absolute value based on the absolute data and difference data, for driving and controlling each of the movable controls of the drive unit 2, such as, a rudder, an elevator and the like.

Now, the embodiment will be described with reference to FIGS. 1A, 1B and 4.

The transmitter 1 acting as transmission means 4 comprises an operation section which includes volumes 10; a digital conversion section which includes a multiplexer 11, an address counter 12, and an A/D converter 13; a storage section which includes an absolute-data memory 14; a subtractor 15; a first data conversion section which includes a difference-data converter 16; a second data conversion section which includes a switch 17, a frame counter 18, and an encoder 19; and a transmission section which includes a high-frequency section 20.

The volumes 10 are associated with movement of the joysticks 9 of the transmitter 1 which are provided corresponding to the number of channels. When the joysticks 9 are shifted to cause each of the movable controls of the drive unit 2 in a predetermined amount, an output voltage of the transmitter 1 is varied in accordance with the displacement of the joysticks 9 so that the transmitter 1 may output an analog signal corresponding to the amount of variation of the voltage.

The multiplexer 11 selectively changes over the analog signals for the respective channels in response to an output pulse from the address counter 12, and supplies the analog signals to the A/D converter 13 in a predetermined order. In this embodiment, the analog signals are alternately supplied to the A/D converter 13 in order of CH1, CH2, CH2, CH1, CH1, CH2 ---.

The A/D converter 13 converts the analog signal in each the channel, which is selectively supplied the A/D converter through the multiplexer 11, into, for example, a ten-bit digital signal. The absolute data in the form of the digital signal is applied to the absolute data memory 14, subtractor 15 and switch 17.

The "absolute data" used herein implies a data which represents the amount of movement of each movable control of the drive unit Z. For example, rotation of a servomotor connected to the movable control of the drive unit is controlled depending on the absolute data.

The absolute-data memory 14 is provided with a storage region corresponding to each of the channels and stores the absolute data converted into the digital signal by means of the A/D converter 13 for each channel. Write and read of the absolute data in the memory 14 are controlled by an output pulse of the address counter 12 so as to be reloaded with the latest data. In this embodiment, the absolute data for the channels CH1 and CH2 are stored in storage regions for the channels CH1 and CH2, respectively.

The subtractor 15 effects subtraction between the absolute data generated from the A/D converter 13 in response to the output pulse of the address counter 12 and the old absolute data preceding by one read out from the absolute-data memory 14. The result of the subtraction is applied to the difference data converter 16 in the form of a difference quantity data.

The difference data converter 16 converts the difference quantity data applied from the subtractor 15 so that it may meet conversion characteristics shown in FIG. 2. For example, it converts a ten-bit difference quantity data into a four-bit one, which is then applied to the switch 17 as a difference data. It is to be noted that conversion characteristics of the difference data are those which compress the difference quantity data to the limited number of bits changing the difference data in stepwise with respect to a variation of the difference quantity data without causing the difference data to be proportional to the difference quantity data so that the movable controls may rapidly moved to an intended position. This is because the difference between the new absolute data and the old absolute data is not always within a four-bit range. Furthermore, in order to prevent excessive rotation of the servomotor, the difference data is set to he smaller than the difference quantity data. The difference data converter 16 ceases to generate the difference data when the difference quantity data amounts to a predetermined value or more. When the upper limit of the value is larger than a response speed of the servomotor, connection to the next absolute data is improved and responsibility is improved.

The switch 17 is so constructed that its contact is selectively changed over or moved to the A/D converter 13 or the difference data converter 16 depending on the output pulse of the frame counter 18 and each data is applied to the encoder 19 depending on changing-over of the contact. The frame counter 18 counts and detects a frame number and supplies an output pulse corresponding to the counted value to the switch 17, thereby selectively changing over the switch 17. When the switch is selectively changed over, a difference data o a new channel CH1 (a difference between a new absolute data of the new channel CH1 and an absolute data of an old CH1), an absolute data of a new channel CH2, a difference data of a newer channel CH2 (a difference between an absolute data of the newer channel CH2 and the absolute data of the new channel CH2), and an absolute data of a newer channel CH1 are applied to the encoder 19 in this order. Subsequently, each of the data is applied to the encoder 19 in this order.

The encoder 19 converts the absolute data and the difference data which are applied to the encoder through the switch 17 into a PCM signal having the form as shown in FIG. 3, which is applied to the high-frequency section 20 at every frame.

A frame is formed of a synchronizing signal (30 bits), the absolute data (10 bits) and the difference data (4 bits). The synchronizing signal is supplied from a control section (not shown) at a predetermined timing. According to the present invention, a synchronizing signal of a first frame, the difference data of the new CH1 and the absolute data of the new channel CH2 are encoded. Then, a synchronizing signal of a second frame, the difference data of the newer channel CH2 and the absolute data of the newer channel CH1 are encoded. Subsequently, encodings are proceeded according to a signal form shown in FIG. 3.

The high-frequency section 20 subjects each data signal supplied from the encoder 19 to frequency modulation, and the modulated signal is transmitted from the antenna as a control signal.

The receiver 3 comprises a receiving section 22; a sampling circuit which includes a clock signal generating circuit 23 and a sampling circuit 24; a synchronizing signal detecting circuit 25, a first conversion section which includes a decoder 29 and a latch circuit 30; a control circuit 31; a storage means which includes an absolute-data memory 32 and a difference-data memory 33; a second conversion section which includes an adder 34 and a switch 35, and a timing generator 36.

The receiving section 22 receives the control signal from the transmitter 1 through an antenna 37 which is demodulated into a signal having the form shown in FIG. 3, and applied to the clock pulse generating circuit 23 and sampling circuit 24.

The clock pulse generating circuit 23 generates a clock pulse in synchronism with an output signal from the receiving section 22. The clock pulse generating circuit 23 comprises a phase locked loop (PLL) circuit and applies a pulse synchronized with the input signal to the sampling circuit 24.

The sampling circuit 24 effects sampling of the output signals of the receiving section 22 in response to the clock pulse generated from the clock pulse generating circuit 23. When a synchronizing signal is detected in the sampling signals by the synchronizing signal detecting circuit 25, the synchronizing signal detecting circuit 25 generates a first detection signal applied to the decoder 29. At the same time, the synchronizing signal detecting circuit 25 detects as to whether it is for the first frame or second frame, and then, a second detection signal is applied to the control circuit 31. An absolute data and a difference data in the sampling signals are applied to the decoder 29.

The decoder 29 decodes the absolute data and difference data from the sampling circuit 24 in response to the first detection signal from the synchronizing signal detecting circuit 25, and each of the decoded data is latched in the latch circuit 30 for a predetermined period of time.

The control circuit 31 distributes the absolute data and difference data in the latch circuit 30 to an absolute-data memory 32 and a difference-data memory 33, respectively, which are provided corresponding to each channel, based on the second detection signal from the sYnchronizing signal detecting circuit 25. More particularly, the synchronizing signal detecting circuit 25 specifies a frame to which the signal is allocated, and distributes an output of the latch circuit 30 to storage regions of the absolute-data memory 32 and difference-data memory 33, respectively, which are provided corresponding to each channel.

In the present invention, the receiving section 22, clock signal generating circuit 23, sampling circuit 24, synchronizing signal detecting circuit 25, decoder 29, latch circuit 30 and control circuit 31 constitute the receiving means 5, and the absolute-data memory 32 and difference-data memory 33 constitute the storage means 6.

The absolute data stored in the absolute-data memory 32 is applied to the switch 35 and the adder 34 acting as conversion means, and also the difference data stored in the difference-data memory 33 is applied to the adder 34.

The adder 34 adds the difference data and the old absolute data preceding by one, and supplies the absolute data next to the old absolute data to the switch 35 as a result of the addition.

The switch 35 is so constructed that its contact may be selectively changed over or moved to the absolute-data memory 32 or adder 34 depending on the control signal from the control circuit 31, and the absolute data for each channel is supplied to the timing generator 36 depending on changing-over of the contact. When the control signal is applied to this switch 35 from the control circuit 31, the absolute data for the respective channels are alternately applied to the timing generator 36 in order of the absolute data for the channel CH1, that for the channel CH2, ---.

The timing generator 36 for forming the drive means 8 which includes the servomotor and a servomoter driving circuit (not shown) serves to delay each of the absolute data, for a predetermined pulse time which is applied in sequence depending on changing-over of the switch 35, based on the control signal from the control circuit 31. Each of the signals delayed for a predetermined pulse time is supplied to the servomotor driving circuit for each channel so as to rotate the servomotor of each channel, to thereby control the movable controls of the model airplane 2, such as, for example, a rudder and the like.

As explained hereinabove, the remote control device of the present invention is constructed so as to alternately transmit the absolute data and difference data. Accordingly, it is capable of increasing a transmission rate and also improving a response speed of the controlled drive unit. Also, even when an absolute value reproduced from the difference data on a side of the transmitter 3 is significantly deviated from its true absolute data, the true absolute data is transmitted in the next frame, which permits an affection due to an error of the difference data to minimize and accurate driving and controlling of the controlled drive unit 2 to be attained. In addition, the difference data is smaller than the difference quantity data. Accordingly, excessive rotation of the servomotor can be prevented.

The present invention has been described in connection with the radio control model airplane. However, it is to be understood that the present invention is applicable to a radio control transmitter and receiver system for an industrial drive unit, such as, a crane, a pile driver or the like.

Also, the remote control device of the present invention has been described in connection with a two-channel system. However, it is a matter of course that it may be applied to a three or more channel systems. In this instance, the volume and number of absolute data memories 14, absolute-data memories 32 and difference data memories 33 are determined depending on the number of channels.

Further, the remote control device of the present invention has been described in connection with a two-channel system wherein a form of a signal to be transmitted is determined so as to apply the synchronizing signal, the difference data for the new channel CH1 and the absolute data for the new channel CH2 in order in the first frame and apply the synchronizing signal, the difference data for the newer channel CH2 and the absolute data for the newer channel CH1 in order in the second frame so that the difference data and absolute data may be applied in each frame for transmitting and receiving the data with a simple circuit. However, the present invention may be so constructed that the synchronizing signal, the absolute data for the newer channel CH1 and the difference data for the newer channel CH2 may be applied in order in the second frame. A similar signal form may be employed even when three or more channels are used.

As can be seen from the foregoing, in the remote control device of the present invention, the absolute data and difference data are alternately transmitted. Accordingly, the transmission rate can be significantly increased without increasing a bandwidth, while minimizing the effect of noise, radio interference and the like. An increase in the transmission rate results in an increase in a response speed of a controlled drive unit. Also, even when the absolute value reproduced from the difference data is significantly deviated from its true absolute data, the true absolute data is applied in the next frame. Accordingly, the effect due to an error of the difference data can be minimized so that accurate driving and controlling of the controlled drive unit may be attained.

While a preferred embodiment of the invention has been described with a certain degree of particularity with reference to the drawings, obvious modifications and variations are possible in the light of the above teachings. It is therefore to be understood that within the scope of the appended claims, the invention may be practiced otherwise than as specifically described.

What is claimed as new and desired to be secured by Letters Patent of the U.S. is:

1. A remote control device comprising:

a transmitter including transmission means for alternately arranging an absolute signal corresponding to an absolute position of controlling devices and a difference signal corresponding to a difference in said absolute position over time of said controlling devices, and for generating a modulated control signal consisting of successive frames of data based thereon, each frame including absolute data and difference data;

a receiver mounted on a control drive unit, said receiver including, receiving means for receiving said control signal and demodulating it into a first absolute data signal and a difference data signal respectively corresponding to said absolute and difference signals derived from said transmission means and alternately generating said first absolute data signal and said difference data signal, storage means for storing said first absolute data signal and said difference data signal therein, conversion means for converting said first absolute data signal of an old frame and said difference data signal of a new frame into a second absolute data signal of only an absolute value and outputting said first and second absolute data signals therefrom, and drive means for driving and controlling controlled devices of said control drive unit alternately in response to said first absolute data signal and said second absolute data signal output by said conversion means.

2. A remote control device as defined in claim 1, wherein said transmission means comprises:

an operation section including said controlling devices for producing signals indicative of the positions of said controlling devices;

a digital conversion section coupled to said operation section for alternately producing digital signals corresponding to the positions of said controlling devices;

a storage section coupled to said digital conversion section for storing said digital signals produced by said digital conversion section;

a first data conversion section coupled to said storage section for producing a signal corresponding to the difference between alternately produced position signals derived from said operation section and stored in said storage section;

a second data conversion section coupled to said digital conversion section and said first data conversion section for producing successive frames of data, each frame including absolute data for the positions of said controlling devices and difference data corresponding to the difference in positions over time of said controlling devices; and a transmission section coupled to said second data conversion section for modulating said successive frames of data produced by said second data conversion section into said modulated control signal and for transmitting said modulated control signal.

3. A remote control device as defined in claim 2, wherein said digital conversion section comprises:

a multiplexer for alternately selecting outputs from said controlling devices and producing an output signal corresponding to the position of a selected of said controlling devices;

an analog/digital converter for converting the output signal of said multiplexer signal to a digital signal; and an address counter for controlling selection by said multiplexer.

4. A remote control device as defined in claim 2, wherein said storage section comprises an absolute data memory.

5. A remote control device as defined in claim 2, wherein said first data conversion section comprises a difference data converter for producing difference data applied to said second data conversion section in accordance with a predetermined conversion characteristic.

6. A remote control device as defined in claim 2, wherein said second data conversion section comprises:

a switch connected to said digital conversion section and said first data conversion section for alternately selecting outputs of said digital conversion section and said first data conversion section;

an encoder for producing said successive frames of data in accordance with a predetermined format; and a frame counter for controlling selection by said switch.

7. A remote control device as defined in claim 1, wherein said receiving means comprises:

a receiving section having an antenna for receiving the modulated control signal transmitted by said transmission means;

a sampling section for sampling received signals received by said receiving section;

a synchronizing signal detecting section coupled to said sampling section for detecting a synchronizing pattern included in a sampled signal produced at the output of sampling section;

a first conversion section coupled to an output of said sampling section and an output of said synchronizing signal detecting section for decoding the absolute data and the difference data from the output of the sampling section in response to a detection signal from the synchronizing signal detecting section;

a control section for controlling the operation of said storage means based on an output signal from said synchronizing signal detection section.

8. A remote control device as defined in claim 7, wherein said sampling section comprises:

a sampling circuit connected to said receiving section; and a clock pulse generating circuit having an input connected to said receiving section and an output connected to said sampling section for generating a clock pulse in synchronism with the output signal from the receiving section to control a sampling time of said sampling circuit.

9. A remote control device as defined in claim 7, wherein said first data conversion section comprises:

a decoder which decodes the absolute data and the difference data from the sampling section; and a latch circuit in which a decoded output produced by said decoder is latched.

* * * * *